United States Patent [19]

Perkins

[11] 4,098,338

[45] Jul. 4, 1978

[54] JARRING METHOD AND APPARATUS FOR WELL BORE DRILLING

[75] Inventor: Lee E. Perkins, Houma, La.

[73] Assignee: Kajan Specialty Company, Inc., Houma, La.

[21] Appl. No.: 754,885

[22] Filed: Dec. 27, 1976

[51] Int. Cl.[2] ..... E21B 1/10

[52] U.S. Cl. ..... 166/301; 175/297; 166/178

[58] Field of Search ..... 175/296, 297; 166/301, 166/178

[56] References Cited

U.S. PATENT DOCUMENTS

| | | | |
|---|---|---|---|
| 2,172,480 | 9/1939 | Osmun | 175/297 |
| 2,678,805 | 5/1954 | Sutliff | 175/297 |
| 2,690,226 | 9/1954 | Comstock | 166/178 X |
| 3,285,353 | 11/1966 | Young | 166/178 X |
| 3,349,858 | 10/1967 | Chenoweth | 175/297 |
| 3,399,741 | 9/1968 | Monroe | 175/297 |
| 3,851,717 | 12/1974 | Berryman | 175/297 |

*Primary Examiner*—Stephen J. Novosad
*Attorney, Agent, or Firm*—Fleit & Jacobson

[57] ABSTRACT

Well bore pressure is utilized to develop an activating pressure during telescoping movement between an outer drill string and an inner mandrel for momentarily locking the mandrel to the drill string. Locking is effected through laterally displaceable mechanical elements carried by the mandrel and held engaged for a predetermined period of time during which an axial tension is applied to the mandrel. A control circuit independent of the amount of axial tension load provides for sudden release of the locking elements at the end of said predetermined period which results in free travel of the mandrel to an impact position to deliver a jarring blow to the drill string for dislodging stuck elements or junk in the well bore.

30 Claims, 18 Drawing Figures

JARRING METHOD AND APPARATUS FOR WELL BORE DRILLING

BACKGROUND OF THE INVENTION

This invention relates generally to jarring devices for fishing and the like and particularly to a jarring apparatus associated with well bore drill strings in order to dislodge the drill string if it becomes stuck in the well bore.

Hydraulically operated jarring devices for well bore fishing and drill strings are well known as disclosed for example in U.S. Pat. No. 3,729,058 and in my prior copending application. Ser. No. 605,057 filed Aug. 15, 1975, now abandoned. Generally in such jarring devices, an inner mandrel is displaced relative to an outer drill string to pressurize an annular body of fluid, the pressurized fluid being abruptly vented to release the mandrel for free travel to an impact position at which point the mandrel delivers a jarring blow to the drill string. By regulating the flow of fluid through a metering valve assembly as disclosed in my prior copending application aforementined, the duration of pressure build up and the intensity of the peak pressure may be adjusted to substantially constant values for each jarring cycle. The pressures developed in such jarring devices depend on the tension applied to the mandrel and the axial contraction of the annular pressure chamber formed between the mandrel and the drill string case. Such pressures are necessarily high if the impact produced on release of the pressure is to be of comparably high intensity.

It is therefore an important object of the present invention to provide a jarring apparatus through which the intensity of the impact is not dictated by the pressure induced in an annular body of fluid within the tool when an impact tension is applied and, therefore, may be tailored to other requirements.

A second important object of the present invention is to provide a jarring apparatus wherein the holding force exerted by a body of fluid pressurized to hold the mandrel and drill string case momentarily against movement relative to each other is applied radially and not axially.

A further important object of the present invention is to provide a jarring apparatus wherein the mandrel and drill string case are momentarily held against relative movement by mechanical engagement achieved by radial displacement of mechanical elements.

A still further object of the present jarring apparatus invention is to achieve rapid disengagement of the mechanical elements momentarily securing the mandrel and drill string case against relative movement with respect to each other by abruptly venting the body of pressurized fluid maintaining such engagement by appropriate valving mechanism and thereby permit relative movement between the mandrel and drill string case according to the tension applied.

Another object of the present invention is to eliminate the high pressure normally induced in the hydraulic fluids in prior devices.

Yet another object of the present invention is to achieve a jarring impact of greater intensity than normally obtainable with prior hydraulic jarring devices which use axially pressurized high pressure chambers.

Still another important object of the present invention is the isolation of the body of fluid pressurized to momentarily hold the mandrel and drill string against relative movement during application of a tension impact load from the fluid circuit generating the activating pressure so that release of the pressurized fluid can be controlled independently of the amount of tension impact load applied.

A further object of the present invention provides a jarring mechanism in which the jarring mechanism automatically immobilizes itself in the absence of a tensional impact load and the apparatus then operates as a telescoping joint.

Additional objects and advantages of the present invention will become apparent from the following descriptions together with the accompanying drawings.

SUMMARY OF THE INVENTION

In accordance with the present invention, telescoping movement of an inner mandrel relative to an outer drill string, pressurizes a body of fluid within a fluid filled cavity formed between the mandrel and the drill string case in order to activate a laterally or radially displaceable mechanical element which momentarily locks the mandrel to the drill string case. The activating pressure is generated by a hydrostatic pump. Initial relative movement of the mandrel with reference to the outer drill string displaces a shiftable seal to trap fluid within a pressure chamber and form a void zone between a differential piston and the drill string. Under the force of the static well bore pressure and the void zone, the differential piston contracts the pressure chamber to generate the activating pressure. Under the influence of the activating pressure, fluid is supplied through a one-way check valve to pressurize sealed pockets from which the locking elements are displaced and held in engagement with matching surfaces laterally fixed to the drill string case. The activating pressure also closes a control valve through which the pockets are subsequently vented to abruptly release the locking elements after the prescribed tensional load has been applied to the mandrel.

Well bore pressure continues to contract the pressure chamber under the influence of the differential piston after development of the activating pressure because of restricted venting of the chamber through a flow metering valve such as that disclosed in my prior copending application aforementioned. Operation of the flow metering valve as described delays release of the locking elements for a short period of time during which an upward tensional load may be applied to the inner mandrel without influencing the activating pressure generated during the initial movement of the mandrel relative to the drill string case.

When the pressure chamber is contracted to a predetermined limit volume, a piston by-pass passage abruptly vents the pressure chamber. Upon venting of the pressure chamber, the control valve automatically opens to vent the body of fluid in the fluid filled cavity and the locking elements are thereby suddenly released to permit free travel of the mandrel to the impact position if under the influence of a tensional load.

DETAILED DESCRIPTION OF THE PREFERRED EMBODIMENTS

Figure 1:
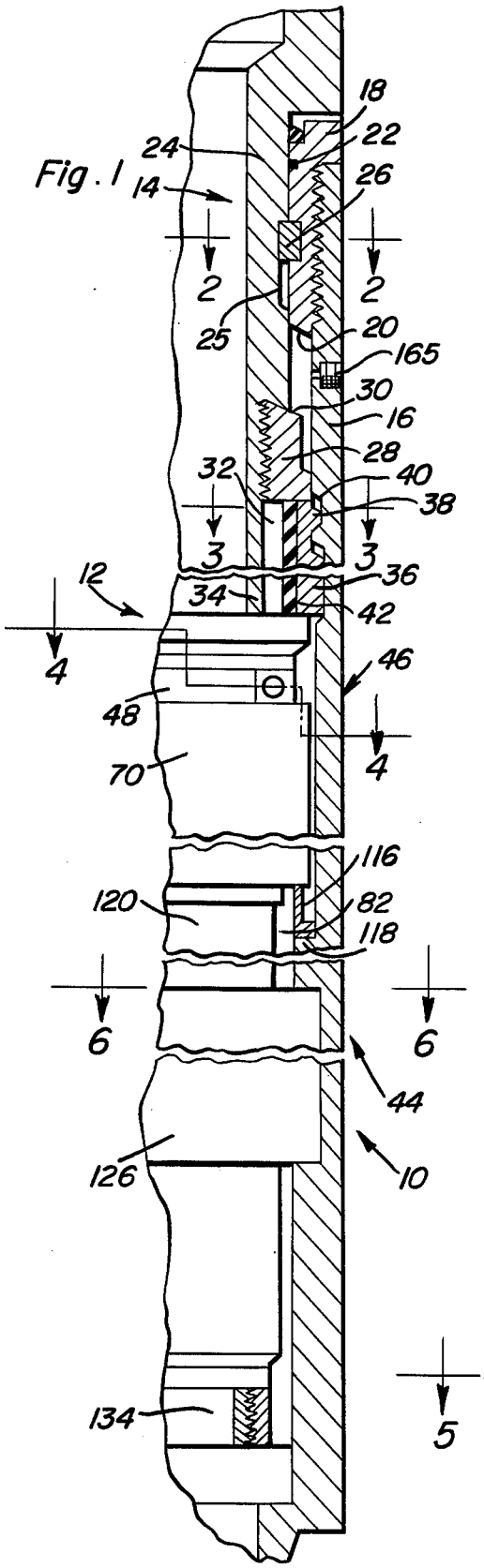
FIG. 1 is a partial side elevation of a typical installation of one embodiment of the present invention before initiation of the jarring cycle with pertinent portions broken away and shown in cross-section.

Referring now to the drawings in detail, FIG. 1 illustrates a typical installation for the jarring apparatus of the present invention which includes an elongated drill string generally referred to by reference numeral 10 adapted to be inserted into a well bore. As is well known in the art, a fishing device (not shown) may be attached to the lower end of the drill string for engagement with drilling equipment to be retrieved. Similarly, the jarring apparatus can comprise part of a drill string to dislodge the drilling components if the same becomes stuck in the well bore. In order to dislodge such equipment or components when stuck in the well bore, an upward jarring blow is delivered to the drill string by jarring apparatus generally referred to by reference numeral 12 carried by a mandrel generally denoted by reference numeral 14, the mandrel being slideably and telescopingly received within the drill string.

Figure 2:
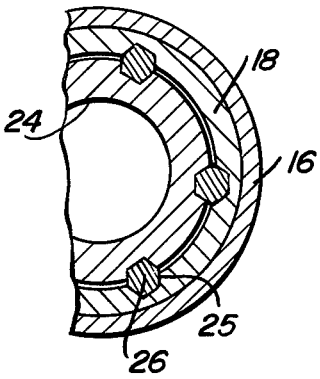
FIGS. 2 and 3 are partial horizontal cross-sections substantially along lines 2—2 and 3—3 of FIG. 1.

The drill string as shown in FIG. 1 includes an outer cylindrical barrel member 16 to which an adaptor 18 is threadedly connected at the upper end, the adapter having an annular anvil surface 20. The adapter is also provided with seals including the seal element 22 in wiping contact with the cylindrical surface of the mandrel body 24. Spline slots 25 are formed in the cylindrical surface of the mandrel body 24 for receiving keys 26 which are retained in the confronting surface of body 18, as more clearly seen in FIG. 2, through which torque is transferred between the body 24 and the adapter 18. Threadedly connected to the mandrel body 24 is a body 28 of a fluid pressure holding device which projects radially outwardly and presents an annular hammer surface 30 that is axially spaced from the anvil surface 20 in the collapsed position of the mandrel and drill string as shown in FIG. 1.

Figure 3:
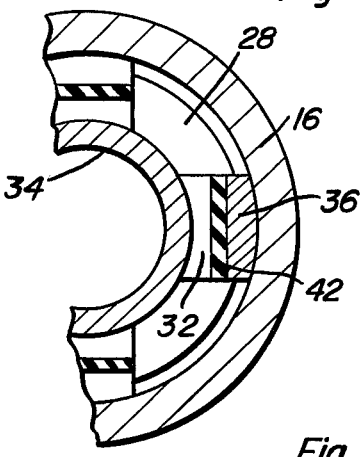

As more clearly seen in FIG. 3, the body 28 has a plurality of circumferentially spaced pockets 32 formed therein about the cylindrical wall 34 of the mandrel within which insert blocks or locking elements 36 of generally rectangular cross-section are positioned for displacement radially or laterally to the longitudinal axis of the drill pipe. The locking blocks or elements 36 are provided with generally cylindrical engaging surfaces having generally circular protruding engagement lugs 38 thereon which are adapted to engage matching grooves 40 formed on the inside surface of barrel member 16 of the drill string in the engaged position as shown in FIG. 1. Lugs 38 and grooves 40 have upper and lower inclined surfaces relative to the longitudinal axis of the drill string and mandrel so as to exert a lateral retracting force component on the elements 36 in response to longitudinal tension applied through the mandrel to the drill string core. Seal pads 42 are positioned behind elements 36 within the pockets 32 to retain pressurized fluid supplied to the pockets for laterally displacing the blocks 36 into engagement with the matching grooves in the barrel member 16 and thereby hold or lock the mandrel and drill string against relative longitudinal movement. The pressurized fluid is supplied to the pockets 32 from a hydrostatic pump or pressure generating assembly generally denoted by reference numeral 44 under the control of a valve controlling assembly generally denoted by reference numeral 46 carried by the mandrel.

Figure 4:
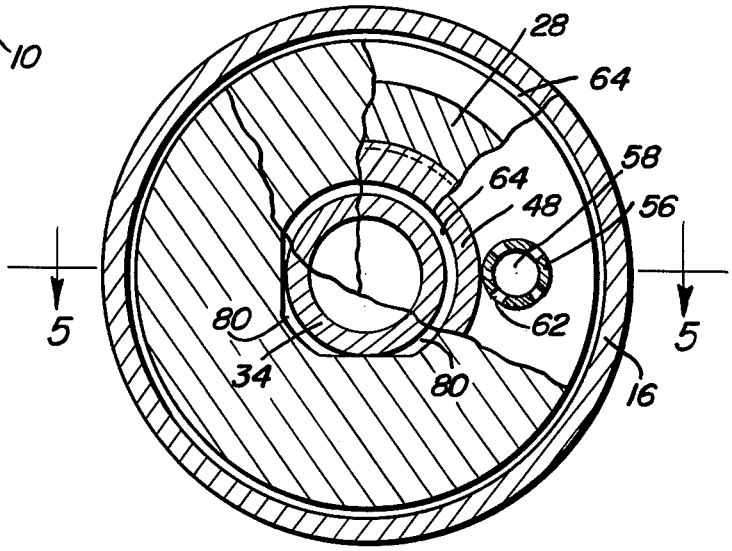
FIG. 4 is a full horizontal cross-section of the entire tool substantially along line 4—4 of FIG. 1.
Figure 5:
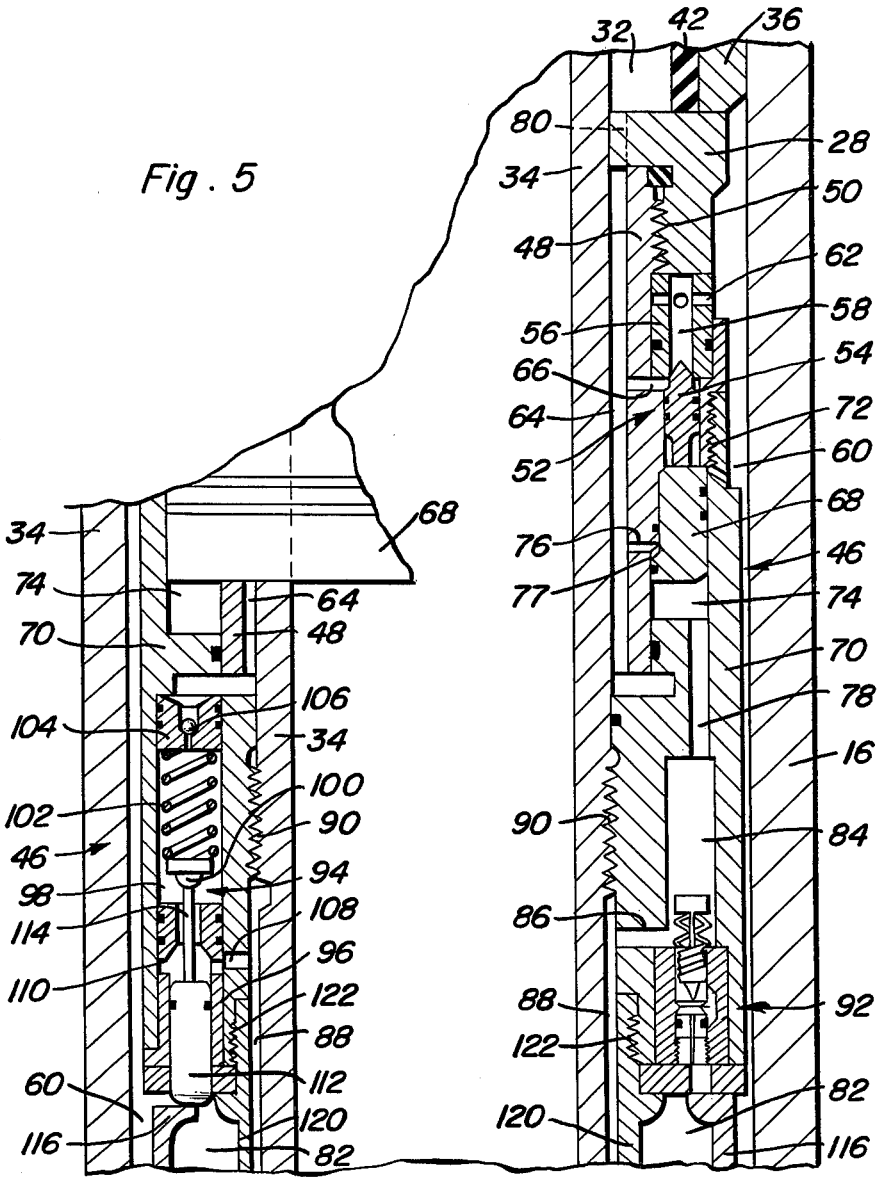
FIG. 5 is an enlarged vertical cross-section substantially along line 5—5 of FIG. 4 with certain components shown in elevation.

With reference to FIGS. 4 and 5 in particular, the valve controlling assembly 46 includes an annular valve body 48 threadedly connected at 50 to the body 28 within which the pressurized pockets 32 are formed. The valve body 48 mounts a fluid operated, pressure holding valve assembly generally referred to by reference numeral 52 which includes an axially displaceable valve element 54 adapted to be seated at the lower end of a tubular valve seat element 56. The valve seat element 56 includes an axial passage 58 which is in fluid communication with an annular passage 60 formed between the cylindrical inner surface of the barrel member 16 and the radially outer surfaces of the valve controlling assembly 46 through the ports 62 in the valve seat element 56. When the valve element 54 is displaced downwardly from its closed position as shown in FIG. 5 to its open position, it establishes fluid communication between annular passage 60 and annular passage 64 formed between the valve body 48 and the radially outer surface of the cylindrical mandrel wall 34 through ports 62, axial passage 58 and port 66 formed in the valve body 48. Annular passage 64 is in fluid communication with the pressurized pockets 32 through passages 80 formed in the valve body 28.

The valve element 54 is urged toward its open position by a fluid pressure opening bias, applied thereto by fluid in passage 66. The valve element 54 is urged toward its closed position by means of a valve operating circular piston 68 slidably and sealingly mounted between the valve body 48 and a valve housing 70 threadedly connected to the valve body 48 by threads 72. The circular piston 68 is biased to the valve closing position as shown in FIG. 5 by pressurized fluid in pressure chamber 74 against the opposing fluid pressure bias of the fluid in passage 64 exerted through port 76 on an upwardly inclined surface 77 on piston 68. Fluid under pressure is supplied to the pressure chamber 74 through passage 78 formed in the valve housing 70. Thus, when chamber 74 is sufficiently pressurized, the valve element 54 will be closed and fluid communication between passages 64 and 58 will be blocked. When the valve element 54 is displaced to its open position, it establishes fluid communication between passage 64 and an exhaust chamber 82 through passages 58 and 60 (as hereinafter described). Thus, the pressure operating pockets 32 are thereby vented for release of the locking elements 36.

Pressurized fluid is supplied to the pressure chamber 74 through passage 78 from cavity 84, port 86 and annular passage 88 formed in the valve housing 70 which is threadedly connected to the mandrel wall at 90. The pressurized fluid so supplied to the pressure chamber 74 for holding the valve assembly 52 closed, is also restrictively vented to the exhaust chamber 82 by means of a flow metering valve device 92 mounted within the valve housing 70. The flow metering device 92 may be and, preferably, is similar in construction and operation to the flow metering device disclosed in my prior copending application aforementioned, Ser. No. 605,057.

The valve housing 70 also mounts a flow control valve device generally referred to by reference numeral 94 through which fluid communication is established between the annular passage 88 and the annular passage 64 for supply of pressurized fluid to the pressure operating pockets 32. The flow controlling valve device 94 includes a tubular valve seat element 96 fixedly mounted within a cavity 98 formed in the valve housing 70. A valve element 100 is biased to a closed position abutting the upper end of the tubular valve seat element 96 by means of a coil spring 102, the opposite ends of which abut the valve element 100 and a valve seat body 104 mounted within the cavity 98 at its upper end. A one-way check valve 106 is enclosed within the valve seat body 104 and is biased to the closed position as shown in FIG. 5 by fluid pressure in annular passage 64 in order to prevent unintended venting of the pressure pockets 32. Thus, when the valve element 100 is in its open position, pressurized fluid will be conducted past the one-way check valve element 106 to the pressure pockets 32 from passage 88 through aligned ports 108 and 110 formed in the valve housing 70 and the tubular valve seat element 96, respectively. The valve element 100 is displaced to the open position against the bias of spring 102 by means of a position responsive, valve operating plunger 112 connected to the valve element 100 by valve stem 114. The lower end of the plunger 112 is adapted to be upwardly displaced to open the valve device 94 by a spacer ring 116, shown in abutment with plunger 112 in FIG. 5, when the mandrel and drill string case are in the collapsed position. In the collapsed position, the spacer ring 116 is held in abutment with plunger 112 by means of the formation 118 (see FIG. 1) which projects radially inwardly from the barrel member 16 and holds spacer ring 116 in position. When opened, the valve device 94 supplies pressurized fluid to the pressure pockets 32 from the pressure generating assembly 44 through annular passages 88.

Associated with the pressure generating assembly 44 is an annular body 120 threadedly connected to the valve housing 70 at 122 (as shown in FIG. 5). The annular body 120 defines the outer wall of the lower portion of annular passage 88 which extends from above port 86 in the valve housing 70 to a pressure chamber 124 at the lower end of the body 120 as more clearly seen in FIG. 7. The pressure chamber 124 is formed between the mandrel wall 34 and an annular differential piston member 128 that is slideably displaceable in an axial direction within the annular cavity from which the exhaust chamber 82 and pressure chamber 124 are formed between the mandrel wall 34 and drill string barrel member 16. An annular housing 126 is fixed to the inside of outer barrel member 16 below formation 118 and extends downwardly below the pressure chamber 124 to form a static pressure chamber 130 separated from the pressure chamber 124 by the differential piston member 128. A balancing pressure piston 132 slideable between the annular housing 126 and a radially inner annular body 134, separates the static pressure chamber 130 from a fluid space 136 in communication with the interior 137 of the drill string mandrel 14 through passage 138. The annular housing 126 is fixed to the barrel member 16 by means of adapter 140 threaded to the bottom of barrel 16. A threaded collar 142 secured to the lower end of the mandrel wall 34 holds the annular body 134 assembled thereon. The fluid space 136 is formed between the annular members 126 and 134 while the passage 138 is formed between the adaptor 140 and the annular body 134.

The piston element 132 isolates the static pressure chamber 130 from the well bore fluids but transfers the static pressure in mandrel interior 137 to the fluid in chamber 130. Thus, by varying the static pressure in mandrel 14, pressure in chamber 130 can be increased and decreased from outside the hole. Accordingly, if increased pressure is needed or desired in chamber 130 to aid in the operation of the pressure generating assembly 44, this can be readily accomplished at the rig floor by applying pressure in the drill string which communicates with interior 137.

The static pressure in chamber 130 is essentially equal to the pressure in exhaust chamber 82 by reason of fluid communication established between the exhaust chamber 82 and static pressure chamber 130 through ports 144 formed at the upper end of the body 126, axial passages 146 formed in the outer wall of housing 126, and ports 148 opening into the pressure chamber 130.

Figure 7A:
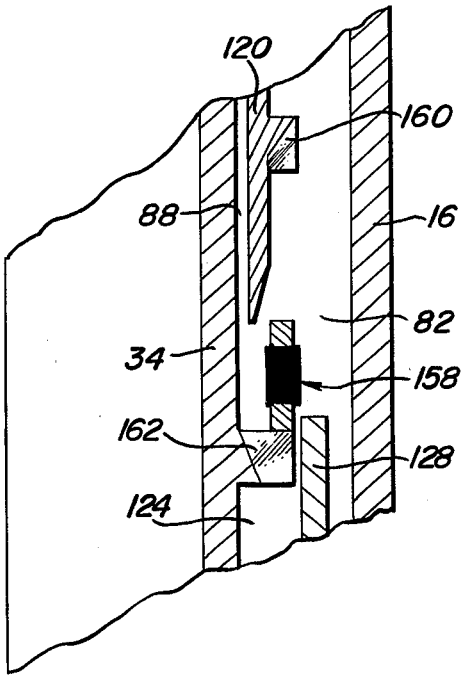
FIG. 7A is an enlarged partial vertical cross-section of the sealing and related elements shown in FIG. 7.
Figures 7, 11:
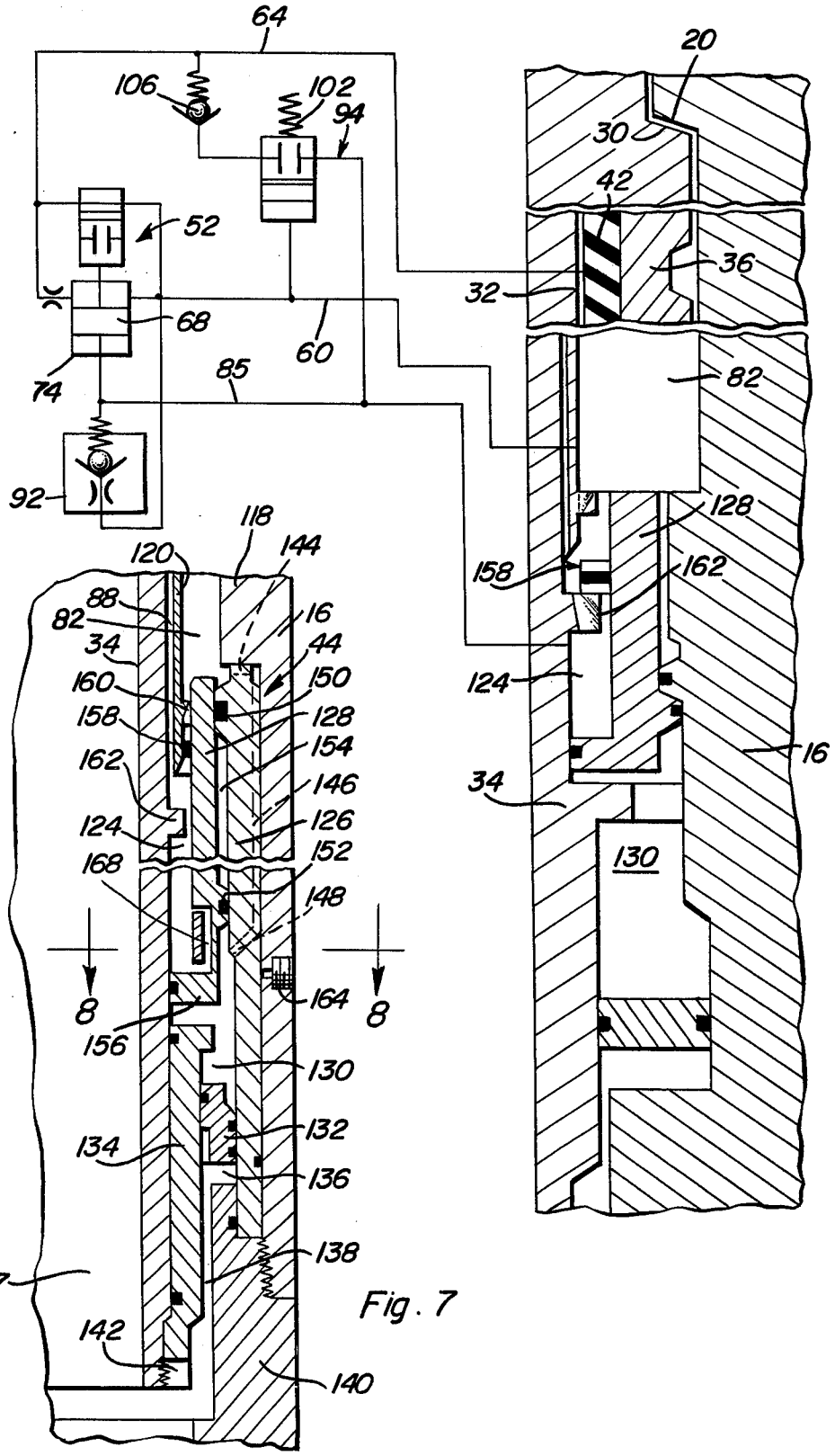
FIG. 7 is a partial vertical cross-section substantially along line 7—7 of FIG. 6.
FIG. 11 is a hydraulic schematic illustration of the control valve assembly in combination with the hydrostatic pump and locking elements in vertical cross-section at the completion of the up-stroke.

The differential piston member 128 is in wiping contact with a wiping seal assembly 150 projecting radially inwardly from the housing 126 adjacent its upper end as more clearly seen in FIG. 7. A wiping seal assembly 152 formed on the differential piston member intermediate its upper and lower ends is in wiping contact with the housing 126 and axially spaced from the wiping seal assembly 150 to form a void space 154 on the radially outer side of the piston member 128. This void space is expanded to the volume shown in FIG. 7 by axial displacement of the mandrel relative to the drill string to the collapsed position shown. A radially inward enlargement 156 of the differential piston at its lower end is in wiping contact with the mandrel wall 34 so as to form pressure faces exposed to the pressure chamber 124 on the radially inner side of the differential piston member and the static pressure chamber 130 on the outer side of the piston member. The upper end of the pressure chamber 124 is adapted to be sealed from chamber 82 by an axially shiftable seal assembly 158 that is displaceable between positions abutting a slotted shoulder formation 160 formed on the body 120 adjacent its lower end, as shown in FIG. 7, and a radial slotted projection 162 formed on the mandrel wall 34, as shown in FIG. 7A. In FIG. 7A, the seal 158 is shown in its lowermost position adjacent slotted shoulder 162 when the jarring mechanism is in its impact position and exhaust chamber 82 is thus in fluid communication with pressure chamber 124 to thereby refill the latter. The exhaust chamber 82 constitutes a reservoir of fluid from which the pressure chamber 124 may be refilled when the shiftable seal assembly 158 is in abutment with the mandrel shoulder formation 162.

In the position shown in FIG. 7 abutting the upper shoulder formation 160, the shiftable seal assembly 158 will effectively seal the pressure chamber 124 so as to enable pressurization of fluid therein in response to upward displacement of the differential piston relative to the mandrel under the bias of the static pressure in chamber 130 and the void space in chamber 154.

A by-pass passage 168 is formed in the differential piston member 128 and extends a predetermined axial distance upwardly from the piston enlargement 156 so that when piston 128 approaches the upper end of its stroke and the upper radial extent of passage 168 passes seal 158, the pressure chamber 124 automatically vents into exhaust chamber 82. Thus, relative displacement of the differential piston member under the urge of the static well bore pressure will pressurize fluid in chamber 124 to hold the valve 54 in valve seat 56 until the pressure chamber is vented by by-pass passage 168 which automatically opens the valve 52 and vents pockets 32 for sudden release of the mandrel so that it may freely travel to strike an impact blow.

Figure 8:
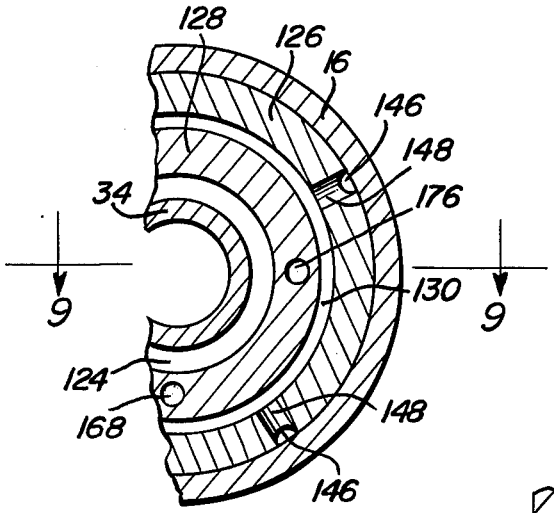
FIG. 8 is a partial horizontal cross-section substantially along line 8—8 of FIG. 7.
Figure 6:
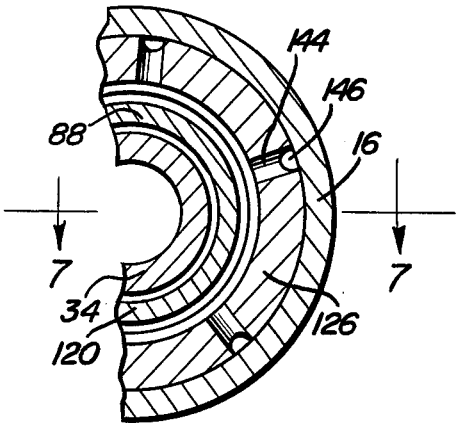
FIG. 6 is a partial horizontal cross-section substantially along line 6—6 of FIG. 1.
Figure 9:
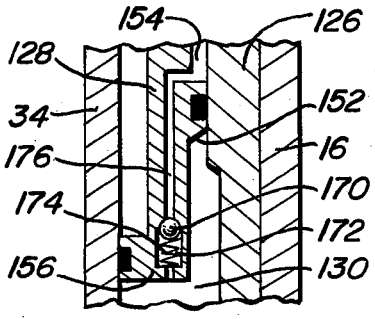
FIG. 9 is a partial vertical cross-section substantially along line 9—9 of FIG. 8.

During travel of the mandrel to the impacting position, the pressure chamber 124 is refilled with fluid from the exhaust chamber as the abutment 160 moves upwardly from the seal 158 until seal 158 rests on lower slotted shoulder 162. In order to enable the differential piston member 128 to extend to its full upper limit position in which seal assembly 152 abuts seal assembly 150, a one-way check valve 170 is mounted within the differential piston member as shown in FIG. 9 in order to exhaust any leakage fluid entrapped in void space 154. Check valve 170 is circumferentially displaced from by-pass 168 as shown in FIG. 8. The check valve 170 is biased to a closed position, as shown, by spring 172 in cavity 174 which is in fluid communication with the static pressure chamber 130. A passage 176 in the piston member extends from the check valve to the void space 154, by-passing the wiping seal assembly 152. Once impaction has occurred and chamber 124 has been refilled, the mechanism is ready to commence a new cycle. The mandrel 34 is then lowered with reference to barrel 16.

Figure 10:
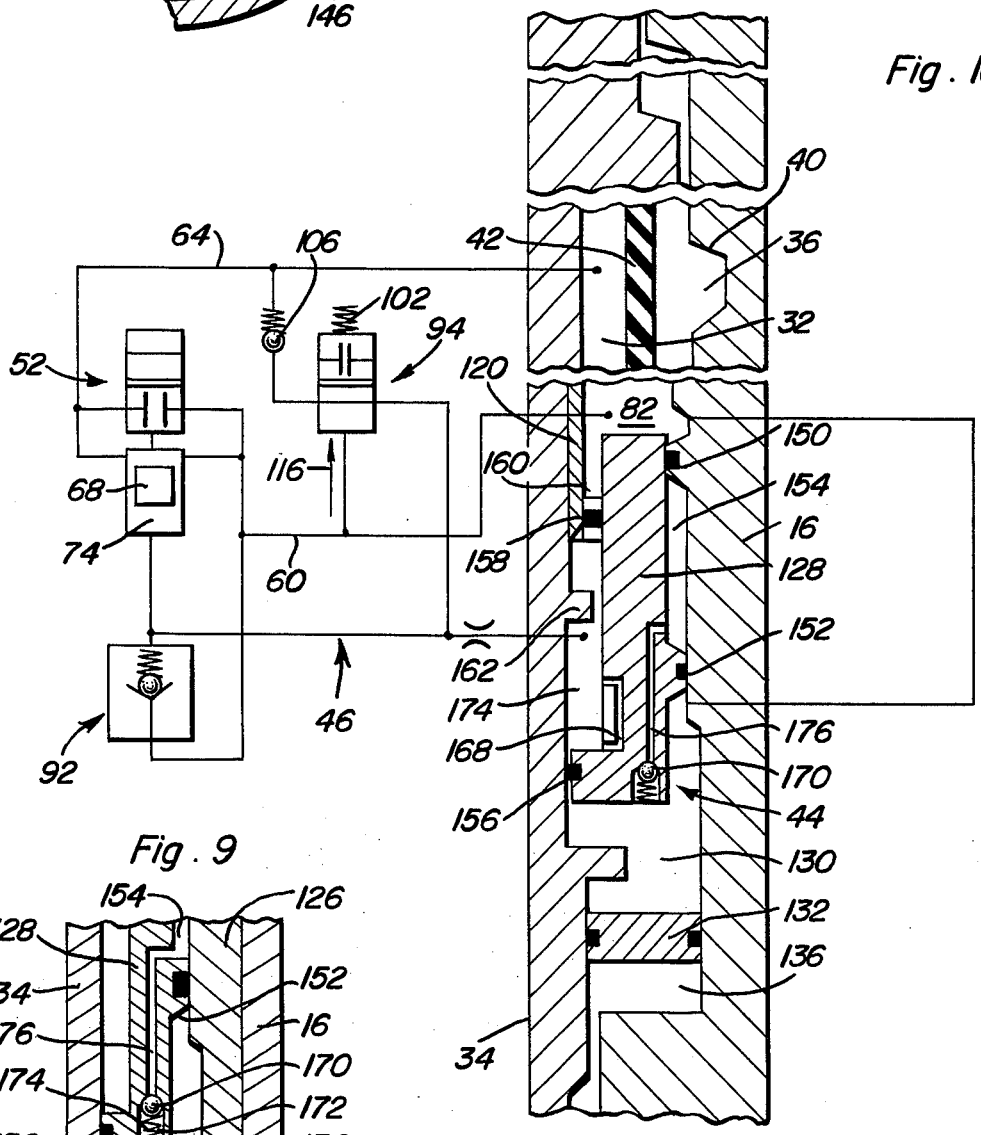
FIG. 10 is a hydraulic schematic illustration of the control valve assembly in cooperation with the hydrostatic pump and locking elements shown in vertical cross-section at the commencement of the up-stroke.

To summarize operation of the jarring apparatus hereinbefore described, reference may be had to the schematic illustration of FIG. 10 which shows the mandrel and drill string in the collapsed engaged position. Downward displacement of the mandrel to the collapsed position shown, causes the shiftable seal device 158 to abut the shoulder formation 160 on the body 120 to close off the pressure chamber 124 and trap a volumetric quantity of fluid therein. With a volumetric quantity of fluid trapped in chamber 124, the differential piston 128 is accordingly displaced with the mandrel 14 as the mandrel moves downwardly to the collapsed position shown, thus resulting in volumetric expansion of the void space 154. Fluid within the pressure chamber 124 can then be pressurized by contraction of the pressure chamber 124 due to upward displacement of the differential piston member 128 under the static pressure of chamber 130. When the pressure so generated in chamber 124 rises above a predetermined activating value to overcome O-ring friction, it operates the valve device 52 through chamber 74 with which the pressure chamber 124 is in fluid communication through passages 88 and 86, chamber 84 and passage 78. The pressure holding valve device 52 is thereby closed as shown in FIG. 5 to prevent venting of the pressure pockets 32 through passage 60 to the exhaust chamber 82. At the same time, pressurized fluid from pressure chamber 124 is conducted through position responsive valve 94 and one-way check valve 106 to the pressure pockets 32 for engaging and holding the locking elements 36 in engagement with the barrel member 16. In this condition, upward tension applied to the mandrel is transferred by the locking elements 36 to the outer drill string case 16, which is prevented from upward travel by some stuck element in the well bore. Upward travel of the mandrel is resisted by the locking elements with a force dependent on the number and axial extent of the locking elements as well as the pressure in the pockets 32, until such time as the fluid within the pressure pockets 32 is vented. By reason of the matching inclined surfaces of lugs 38 and grooves 40, any upward displacement of mandrel 14 relative to drill string casing 12 will tend to cam locking elements 36 inwardly thereby further increasing the fluid pressure in pockets 32 in view of the closed valve device 52 and one-way check valve 106. Furthermore, once pockets 32 become pressurized, the third pressure circuit for retaining the locking elements engaged becomes isolated from the hydrostatic pump or pressure activating assembly.

The period of time during which the pressure pockets 32 are maintained pressurized is determined by the flow metering valve 92 connected to the passage 88 in parallel with the pressure operating chamber 74 for the pressure holding valve device 52. The flow metering valve 92 conducts a restricted flow of fluid from the pressure chamber 124 to the exhaust chamber 82 in order to permit the differential piston member 128 to be displaced upwardly at a regulated rate while maintaining the activating pressure within pressure chamber 124. Thus, the period of time during which pockets 32 are pressurized, and locking elements are engaged, is not in any way dependent upon the tensional load applied to the mandrel 14 for impact purposes. Instead, the time delay is dependent solely upon the rate of metered flow of the actuating pressure fluid permitted through meter 92 and the time it takes for differential piston member 128 to reach a seal by-pass condition.

Figure 5A:
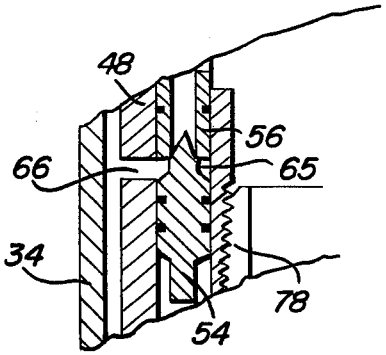
FIG. 5A is an enlarged partial vertical cross-section of certain of the pressure holding valve assembly components shown in FIG. 5.

At the upper end of its stroke, the differential piston member 168 automatically vents pressure chamber 124 through by-pass passage 168 around seal 158 into exhaust chamber 82 thus resulting in the venting of the operating chamber 74 of the pressure holding valve 52. The valve 52 will accordingly be displaced to its "open" position by reason of the pressure in pockets 32 and annular passage 64. More specifically, when the pressure in chamber 74 is vented, the pressure in passages 64 and 76 exert a downward force on circular piston 68 through inclined surface 77. Similarly, as circular piston 68 moves downwardly, the pressure in passages 64, 66 and 65 (see FIG. 5A) exerts a downward force on valve element 54 to rapidly disengage the valve element from valve seat element 56. In this "open" position, the pressure pockets 32 are suddenly vented through passages 64, 66, 58, 62 and 60 into exhaust chamber 82.

The locking elements 36 will accordingly be laterally displaced by the lateral component of the forces transmitted to the locking elements by the camming surfaces of the circular grooves 40 in the barrel members 16. The mandrel will then be free to travel upwardly to the impact position as shown in FIG. 11. During travel of the mandrel to the impact position, the axially shiftable seal device 158 will abut the mandrel shoulder projection 162 so as to permit fluid communication between the pressure chamber 124 and the exhaust chamber 82. The pressure chamber 124 is accordingly refilled with fluid in preparation for the next jarring cycle. Also, as the mandrel travels up to the impact position, the plunger 112 associated with the flow control valve 94 is disengaged from the spacer element 116 so that the valve 94 may be displaced to the closed position shown in FIG. 11 under the bias of its spring 102. The valve 94 remains closed to prevent pressurization of the pressure pockets 32 until such time as the mandrel is returned to its collapsed position relative to the drill string case and position locking elements 36 are positioned opposite corresponding circular grooves 40 in barrel 16 at which point plunger 112 engages spacer ring 116.

One important advantage in the design of the jarring mechanism of FIGS. 1–11 is that, under certain circumstances, the mechanism allows for free telescoping movement between the mandrel 14 and barrel 16. More specifically, when mandrel 14 commences its downward movement with reference to barrel 16 from a position in which the hammer 30 is adjacent anvil 20, the normal pressurization cycle commences. After the mandrel attains its down position, fluid pressure is transmitted to pockets 32 as above described. If no tension is applied to the mandrel 14 after the locking elements 36 become engaged, the fluid pressure generated by the pressure generating assembly or hydrostatic pump 44 is dissipated, and the pressure in pressure pockets 32 will reopen control valve 52 and vent the pockets thus permitting retraction of locking elements 36. Free telescoping upward movement of mandrel 34 with reference to barrel 16 can then proceed. The free telescoping cycle can be repeated as necessary so long as tension is not applied to the mandrel 24.

Figure 12A:
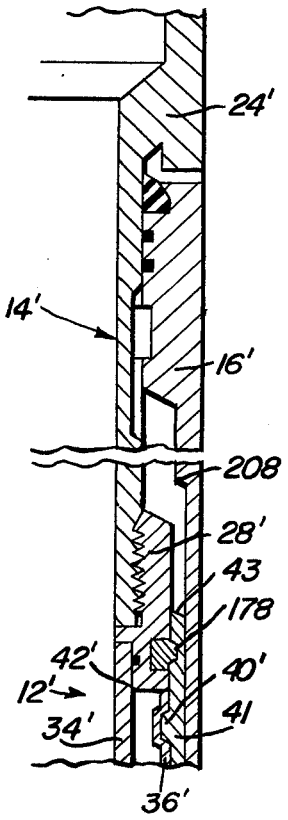
FIGS. 12-A, B and C are partial vertical cross-sections of an alternate embodiment of the present invention with certain components shown in side elevation.

In the jarring apparatus 12 hereinbefore described with respect to FIGS. 1–11, the mechanical locking elements 36 are releasably held engaged by fluid pressure means activated during the down-stroke travel of the mandrel to the collapsed position for each jarring cycle. According to another embodiment shown in FIGS. 12A, 12B and 12C, fluid pressure holding means for the mechanical locking elements is activated during the up-stroke travel of the mandrel from the bottom or collapsed positon, for each jarring cycle. This requires some modification of the mechanical locking means and other components hereinbefore described and is accompanied by the omission of any position responsive valve device, such as the valve device 94 hereinbefore described in connection with the jarring apparatus 12. According to the modified embodiment, the jarring apparatus 12' as shown in FIGS. 12A, B and C will be activated to engage and lock the mandrel 14' relative to a cylindrical housing 41 during the initial stages of the upward travel of the mandrel 14'. Cylindrical housing 41' is permitted limited axial movement within barrel 16' so that when locked to mandrel 14', housing 41 moves upwardly with the mandrel a predetermined distance until its upper surface 43 abuts surface 208 on barrel 16'. When such locking and abutment occur, continued tension applied to the mandrel in an upward direction is resisted by the holding force of the mechanical means until such time as the holding pressure is suddenly released to permit continued upward free travel of the mandrel to the impact position completing a jarring cycle. The jarring apparatus 12' is conditioned for activation during downward travel of the mandrel to the collapsed position shown in FIGS. 12A, B and C.

Figure 12B:
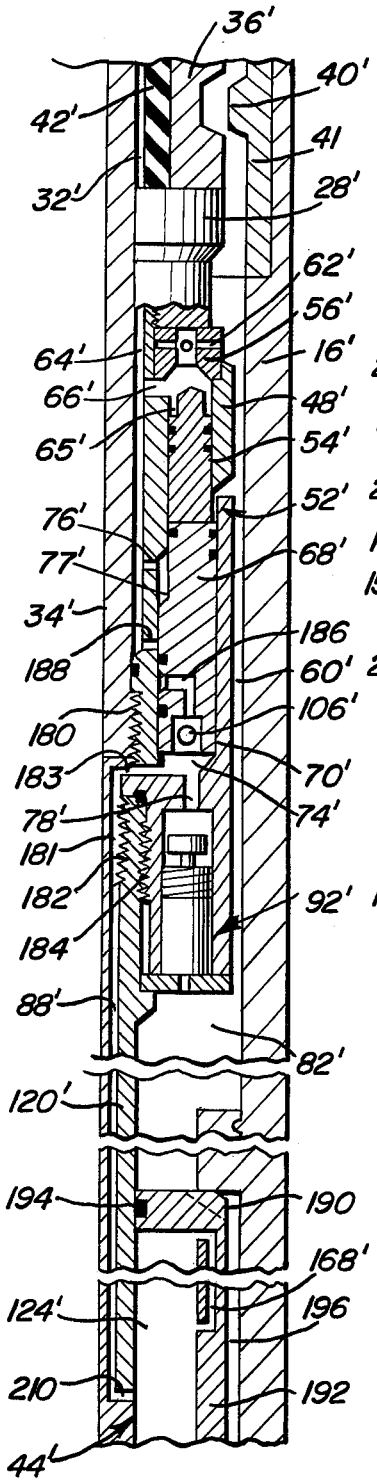

The mandrel 14' is threadedly connected to a hammer body 28' in axially spaced relation to an anvil shoulder 18' secured to the barrel member 16' as in the case of the assembly shown in FIG. 1. The body 28' also encloses pressure pockets 32' from which locking elements 36' are radially or laterally displaced into engagement with matching elements 40' of housing 41 for locking the mandrel thereto. The laterally displaceable locking elements 36' and matching elements 40' are structurally and functionally similar to those associated with the mechanical locking means hereinbefore described in connection with the jarring apparatus 12. However, the cylindrical housing 41 and its matching elements 40' as shown in FIGS. 12A and 12B may be axially displaced relative to the barrel member 16' by a limited amount to accomodate axial movement thereof with the locking elements 36' during the initial up-stroke travel of the mandrel while the pressure holding means is being activated. A compression ring 178 is therefore mounted on the body 128 for engagement with the uppermost groove in the housing 41 as shown in FIG. 12A. The housing 41 is, therefore, displaced with the mandrel at the beginning of its up-stroke travel so as to maintain the groove elements 40' in proper alignment with the locking elements 36' to be subsequently displaced into engagement. As mandrel 34' is moving upwardly in its initial travel together with housing 41 through engagement with compression ring 178, locking elements 36' are displaced into engagement with matching grooves 40'. When housing 41 reaches its upper limit, the tool is then ready for tensioning to establish impact force. When impact force is established and locking elements 36' have become disengaged, the engaged surface of the top element 40' will laterally or radially cam the compression ring 178 out of engagement in order to fully disengage the mandrel from the housing 41 and allow continued upward travel of the mandrel to achieve impact. The compression ring 178 is engageable with the housing 41 only through the top groove of elements 40' so as to ensure proper positioning of the locking elements 36' with the remaining elements 40'. After impact, as the mandrel 34' is being lowered, the compression ring 178 will engage housing 41 and return it to its lowermost position as shown in FIGS. 12A and B and at the same time, ring 178 will reset itself in the top groove.

Threadedly connected to the body 28' is a valve body 48' enclosing a pressure holding valve device 52' similar in operation and function to the pressure holding valve device 52 hereinbefore described with respect to jarring apparatus 12. The valve device 52' thus includes an axially movable valve element 54' upwardly displaced to a closed position by a valve operating circular piston 68'. The valve element 54' is biased to its open position as shown in FIG. 12B by fluid pressure in the pressure pockets 32' communicating with the valve element through passage 64', port 66' and cut-out passage 65'. Valve piston 68' is biased toward its lower position as shown in FIG. 12B by the fluid in passage 64' exerted through port 76' on upwardly inclined surface 77' on the inner side of piston 68'.

In its open position, the valve device 52' establishes fluid communication between the pressure pockets 32' and exhaust chamber 82' through the ports 62' in the tubular valve seat element 56' and the passage 60' formed between the barrel member 16' and the valve housing 70' to which the valve body 48' is connected. The valve body 48' is threadedly connected at 180 to the mandrel wall 34'. The mandrel wall 34' is also threadedly connected at 182 to an annular sleeve 120' to which the valve housing 70' is threadedly connected at 184 to form an assembly with the mandrel. A pressure operating chamber 74' is formed between the valve housing 70' and the lower end of the operating piston 68'. The valve housing 70' also encloses flow metering valve 92' similar to the flow metering valve 92 hereinbefore described. Fluid communication between the flow metering valve 92' and the valve operating chamber 74' is established by passage 78' in the valve housing 70' while pressurized fluid is supplied to the operating chamber 74' from annular passage 88' that extends between the mandrel wall 34' and the annular sleeve 120' through circumferentially spaced axial slots 181 in threads 182 which communicate with radial ports 184 into chamber 74'.

A one-way check valve 106' that is functionally similar to the one-way check valve 106 hereinbefore described is mounted in and carried by the valve operating piston 68' adjacent its lower end. The check valve 106' is biased to a closed position blocking flow from passage 64' to chamber 74' through piston mounted passage 186. Further, in its lower position, passage 186 is blocked by the lower portion of housing 48'. When the fluid pressure from the hydrostatic pressure generating assembly 44' is initially transmitted to chamber 74', it drives piston 68' upwardly to close valve device 52' and align passage 186 with port 188 to establish fluid communication between the hydrostatic pump 44 and passageway 64'. Thus, when the chamber 74' is pressurized to displace the valve device 52' to its closed position, pressurized fluid from passages 88' may flow past the check valve 106' into the passages 64' through port 188 in the valve body 48' in order to pressurize the pockets 32'.

Figure 12C:
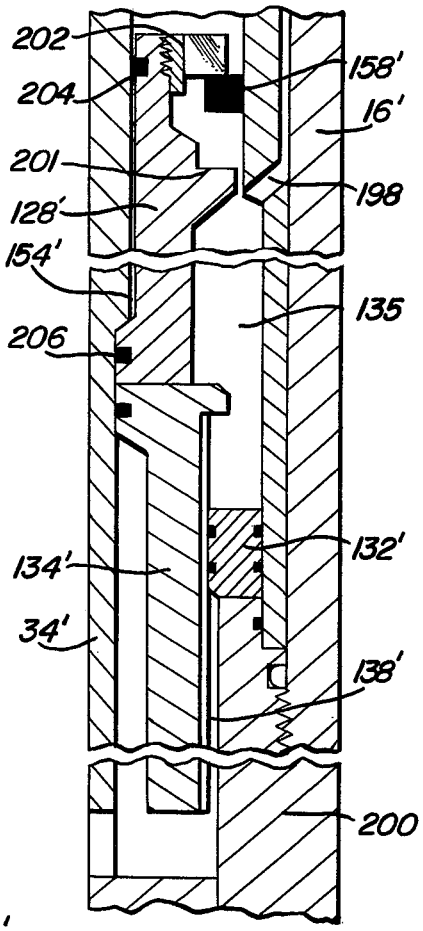

The exhaust chamber 82' is separated from a pressure chamber 124', with which the passages 88' communicate, by the enlarged upper end portion 190 of a sleeve 192 fixed to the barrel 16 as shown in FIGS. 12B and 12C. Seal 194 on end portion 190 in contact with annular sleeve 120' separates the exhaust and pressure chambers. A by-pass passage 168' is formed in the sleeve 192 below the portion 190. The sleeve 192 has passages 196 formed therein for establishing fluid communication between the exhaust chamber 82' and a well bore static pressure chamber 130' through a port 198 in the sleeve. The sleeve 192 includes a portion of reduced thickness below port 198 as shown in FIG. 12C enclosing the chamber 130' within which a balancing piston 132' is displaceable. The annular piston 132' separates chamber 130' from the well bore fluids in communication therewith through passages 138' formed between lower end adapter 200 of the drill string case and sleeve 134' in wiping contact with the mandrel wall 34' at the upper end of the sleeve. The sleeve 134' limits downward movement of a differential piston 128' separating pressure chamber 124' from the static pressure chamber 130'. A shiftable seal device 158' is movable relative to the piston 128' between its abutment shoulder projections 201 and an upper slotted collar attachment 202 as shown in FIG. 12C. When abutting the projection 201, the seal device 158 will seal the pressure chamber 124' from chamber 130'.

As the mandrel is initially raised from the bottom or collapsed position shown in FIGS. 12A, 12B, and 12C, the suction in void space 154' or the hydrostatic pressure operating on the differential area between seals 204 and 206 will cause the differential piston 128' to move upwardly with mandrel 14' until projection 201 engages seal device 158' to seal the pressure chamber 124' from chamber 130' within sleeve 192 on which the seal device is slidable. When the chamber 124' is sealed, continued upward movement of the mandrel 34' will cause pressure generation in chamber 124' by reason of the upward force exerted on differential piston 128' due to void space 154'. In other words, the pressure generated in chamber 124' will be a function of the void space expansion and the differential forces acting on the opposed pressure faces respectively exposed to the chamber 124'.

Pressure generated in chamber 124' during upward travel of the mandrel, is communicated to valve device 52' through radial passage 210 and annular passage 88' causing operating piston 68' to rise and valve element 54' to close, sealing pressure pockets 32' from the exhaust chamber 82'. Thereafter, with passageway 186 aligned with port 188, pressurized fluid is conducted past check valve 106' to the pressure pockets 32' through passage 64' to cause the locking elements 36' to engage elements 40' carried with the mandrel in matching alignment by compression ring 178. When the housing 41 abuts the shoulder 208 of the barrel member 16 shown in FIG. 12A, further upward travel of the mandrel is prevented. However, sufficient movement of mandrel 14' has taken place relative to differential piston 128' to elongate void space 154' sufficiently to allow the differential piston 128' to move to the top of chamber 124' as fluid passes through meter 192' to chamber 82'. The desired tensional stress may then be applied to the mandrel 14' for a period of time determined by flow metering device 92'. As fluid proceeds through meter 92', differential piston 128' moves upwardly through chamber 124 until seal 158' positioned on abutment 201 passes the lower radial section of by-pass passages 168'. In this position, chamber 124' automatically vents into chamber 130' and the locking elements 36' are suddenly released under control of valve device 52' as hereinbefore described with respect to valve device 52.

The pressure pockets 32' are accordingly vented which enables locking elements 36' to be retracted as the mandrel is released for continued free upward travel for impact. Such rapid upward travel of the mandrel, as previously described, causes compression ring 178 to disengage and when port 210 at the lower end of passage 88' passes the upper end portion 190 of sleeve 192, communication between chamber 124' and the pressure pockets is blocked to prevent any repressurization of the pressure pockets during the impact stroke.

Figure 13:
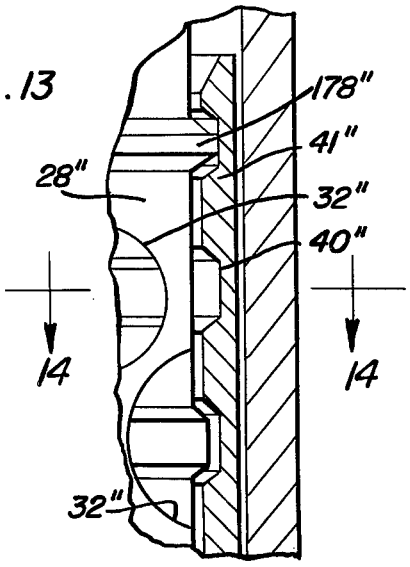
FIG. 13 is a side elevation, with certain components in vertical cross-section, of a further alternate embodiment of the locking elements of the present invention.
Figure 14:
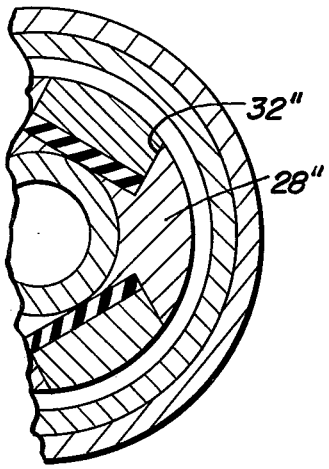
FIG. 14 is a partial horizontal cross-section along line 14—14 of FIG. 13.

The locking elements 36 and 36' hereinbefore described with respect to FIGS. 1, 3 and 12A are limited in number by the circumferential extent of the body 28 or 28' within which axially extending pressure pockets are formed. In another embodiment shown in FIGS. 13 and 14, cylindrical pockets 32'' are formed at axially and circumferentially spaced locations about a modified body 28'' yieldably held in alignment with cylindrical matching elements 40'' of a single cylindrical housing or sleeve 41' by a compression ring 178'. Locking elements 36'' are generally cylindrical in shape with its mating face following a cylindrical contour to mate with the inner surface of sleeve 41. Lugs 38" project from the mating surface of locking elements 36" into engagement with the matching elements 40" of the sleeve type housing 41'. Alternatively, annular grooves are formed in the drill string case itself for engagement by the locking elements as in the case of the embodiment shown in FIGS. 1-11.

It will be readily appreciated by those skilled in the art that numerous modifications and variations of the present invention are certainly possible in light of the above teachings. It should therefore be understood that the foregoing description has been given merely for purposes of illustration, and is in no way intended to limit the scope of the present invention. Rather, it is intended that the present invention may be practiced otherwise than as specifically described above, and should be limited only as defined in the appended claims.

What is claimed is:

1. In combination with a pair of members adapted to be inserted into a well bore for relative displacement along a longitudinal axis between a collapsed position and an impact position, a jarring apparatus including mechanical means displaceable laterally of said longitudinal axis to an engaged position for preventing said relative displacement of the members, fluid pressure means for releasably holding the mechanical means engaged, means responsive to said relative displacement of the members for generating a predetermined activating pressure, pressure control means connected to the pressure generating means for supplying said activating pressure to the releasable pressure holding means to engage said mechanical means, and delayed action release means connected to the pressure holding means to vent said activating pressure after a predetermined period of time following engagement of the mechanical means.

2. The combination of claim 1 wherein said mechanical means includes a longitudinally fixed locking element carried by one of the members, and a laterally fixed matching element carried by the other of the members, said elements having engaging surfaces extending at an angle to the longitudinal axis to exert a lateral retraction force on the locking element in response to longitudinal tension applied to one of the members.

3. The combination of claim 2 including means for slideably mounting the matching element on the other of the members for longitudinal displacement within limits when engaged by the locking element during movement toward the impact position.

4. The combination of claim 2 wherein said pressure control means includes a pressure responsive check valve conducting pressurized fluid in one direction only to the fluid pressure holding means.

5. The combination of claim 1 wherein said delayed action release means includes a pressure operated valve device connected to the fluid pressure holding means for abruptly venting the same, means connecting the pressure generating means to the pressure operated valve device for supply of fluid under said activating pressure to the valve device to prevent said abrupt venting of the fluid pressure holding means, and flow metering means connected to the pressure generating means for restrictively venting the same to delay said abrupt venting of the pressure holding means.

6. The combination of claim 5 wherein said pressure generating means includes means mounted on said members for forming a fluid filled cavity therebetween, static pressure transferring means for sealing the cavity from the well bore, differential piston means mounted in the cavity for establishing pressure and exhaust chambers therein, and displaceable seal means mounted on the piston means for sealing the pressure chamber in response to said relative displacement of the members to pressurize the fluid therein above the static pressure in the well bore.

7. The combination of claim 6 wherein said delayed action release means includes a pressure operated valve device connected to said fluid pressure holding means for abruptly venting the same and by-pass passage means mounted by the piston means in by-pass relation to the seal means for venting the pressure chamber in response to said contraction of the pressure chamber, said pressure chamber being connected to the pressure operated valve device.

8. The combination of claim 7 wherein said pressure control means further includes position responsive valve means connected in series with the check valve between the pressure chamber and the fluid pressure holding means for blocking flow of fluid above said activating pressure until the members are in the collapsed position.

9. The combination of claim 1 wherein said pressure control means includes position responsive valve means connected to the fluid pressure holding means for blocking flow of fluid thereto above said activating pressure until the members are in the collapsed postion.

10. The combination of claim 1 wherein said delayed action release means includes a pressure operated valve device connected to the fluid pressure holding means for abruptly venting the same, means connecting the pressure generating means to the pressure operated valve device for supply of activating pressure to the valve device to prevent said abrupt venting of the fluid pressure holding means, and flow metering means connected to the pressure generating means for restrictively venting the same to delay said abrupt venting of the pressure holding means.

11. The combination of claim 1 wherein said pressure generating means includes means mounted on said members for forming a fluid filled cavity therebetween, static pressure transferring means for sealing the cavity from the well bore, differential piston means mounted in the cavity for establishing pressure and exhaust chambers therein, displaceable seal means mounted on the piston means for sealing the pressure chamber in response to said relative displacement of the members to pressurize the fluid therein above the static pressure in the well bore.

12. The combination of claim 11 wherein said delayed action release means includes by-pass passage means mounted by the piston means in by-pass relation to the seal means for venting the pressure chamber in response to said contraction of the pressure chamber.

13. The combination of claim 12 wherein said piston means includes an elongated body having opposing pressure faces respectively exposed to well bore pressure and the fluid in the pressure chamber and a formation enclosing a void space expanded in response to said relative displacement of the members.

14. The combination of claim 11 wherein said piston means includes an elongated body having opposing pressure faces respectively exposed to well bore pressure and the fluid in the pressure chamber and a formation enclosing a void space expanded in response to said relative displacement of the members.

15. The combination of claim 1 wherein said pressure control means includes a pressure responsive check valve conducting pressurized fluid in one direction only to the fluid pressure holding means.

16. The combination of claim 15 wherein said pressure control means further includes position responsive valve means connected in series with the check valve for blocking flow of fluid from the fluid pressure holding means.

17. The combination of claim 1 wherein said means for generating a predetermined activating pressure is a hydrostatic pump.

18. In combination with a pair of members adapted to be inserted into a well bore for relative displacement parallel to a longitudinal axis between a collapsed position and an impact position, a jarring apparatus including fluid pressure holding means for releasably preventing said relative displacement of the members, means responsive to said relative displacement of the members for generating a predetermined activating pressure, pressure control means connected to the pressure generating means for applying said activating pressure to the releasable pressure holding means to prevent said relative displacement for a predetermined period of time, and delayed action release means for deactivating the fluid pressure holding means to enable said relative displacement of the members to the impact position after tension has been applied to one of the members.

19. The combination of claim 18 wherein said delayed action release means includes a pressure operated valve device connected to the fluid pressure holding means for abruptly venting the same, means connecting the pressure generating means to the pressure operated valve device for supply of fluid under said activating pressure to the valve device to prevent said abrupt venting of the fluid pressure holding means, and flow metering means connected to the pressure generating means for restrictively venting the same to delay said abrupt venting of the pressure holding means.

20. The combination of claim 18 wherein said pressure generating means includes means mounted on said members for forming a fluid filled cavity therebetween, static pressure transferring means for sealing the cavity from the well bore, differential piston means mounted in the cavity for establishing pressure and exhaust chambers therein, displaceable seal means mounted on the piston means for sealing the pressure chamber in response to said relative displacement of the members to pressurize the fluid therein above the static pressure in the well bore.

21. The combination of claim 20 wherein said piston means includes an elongated body having opposed pressure faces respectively exposed to well bore pressure and the fluid in the pressure chamber and a formation enclosing a void space expanded in response to said relative displacement of the members.

22. A jarring apparatus for use in a well bore or the like which comprises:

an inner and an outer telescopingly engaged longitudinal bodies;

mechanical means displaceable laterally for locking said bodies together against relative longitudinal movement;

fluid pressure means for releasably holding the mechanical means to lock and unlock said bodies together;

means to activate said fluid pressure means prior to applying a tensioning force tending to move said bodies longitudinally with respect to each other; and means to deactivate said fluid pressure means after applying said tensioning force to thereby disengage said mechanical means and allow relative longitudinal movement between said bodies.

23. The jarring apparatus of claim 22 wherein said mechanical means for locking said bodies together include a series of axially and circumferentially spaced, generally cylindrical, laterally displaceable locking elements on the inner body and a series of grooves on said outer body axially spaced to align with the axial spacing of said locking elements.

24. A hydraulic jarring device comprising:

an elongated, generally hollow barrel;

an elongated mandrel co-axially mounted within said barrel and adapted to move relative thereto in an axial direction;

anvil means mounted on one of said barrel or said mandrel and hammer means axially aligned with said anvil means mounted on the other;

means to retain said barrel and mandrel against relative movement when tension is applied to one or the other;

means to activate said retaining means prior to applying a tension force to either said barrel or said mandrel;

means for generating a pressure independent of the jarring hydraulic pressure; and means operable by said independent pressure to deactivate said retaining means.

25. In a hydraulic jarring device including a pair of longitudinal telescoping members, releasable holding means for retaining said members against relative displacement with respect to each other under a tensional impact load applied to one of said members and means for generating an activating pressure to operate said releasable holding means, the improvement wherein said means for generating said activating pressure is operably connected to said telescoping members such that said activating pressure is generated solely by the relative displacement of the longitudinal members.

26. In combination with a pair of longitudinal members adapted to be inserted into a well bore or the like for relative displacement between a collapsed position and an impact position, a jarring apparatus including:

means for preventing relative displacement of the members;

fluid pressure means for releasably holding said preventing means in an engaged position; and pressure control means isolated from said pressure holding means for maintaining said preventing means engaged for a predetermined period of time and for thereafter deactivating said holding means to allow relative displacement between said membrers.

27. In a jarring apparatus for applying impact between two elongated longitudinally aligned members wherein fluid pressure means retains said elongated members against relative displacement when a tension load is applied and means for activating and deactivating said fluid pressure means by means of hydraulic pressure, the improvement which comprises means communicating with the hydrostatic pressure ambient said jarring apparatus for controlling the rate of said activation and deactivation and the hydraulic pressure at which said activation and deactivation occurs solely as a function of said hydraulic pressure.

28. In a jarring apparatus including a pair of longitudinally telescoping members, releasable holding means for retaining said members against relative displacement with respect to each other under an amount of applied tension to one of said members, and control means for operating said releasable holding means, the improvement which comprises said control means operating said releasable holding means independently of the amount of applied tension.

29. In a jarring apparatus for applying an impact between two elongated longitudinally aligned members by relative axial travel with respect to each other including releasable holding means for retaining said members against relative displacement with respect to each other, fluid pressure means to activate said releasable holding means into a retaining position for retaining said members against relative displacement with respect to each other and to deactivate said releasable holding means from said retaining position after a period of time to allow relative displacement between said members, the improvement which comprises said fluid pressure means being capable in the absence of tensional load to deactivate said releasable holding means without imparting impact between said two members.

30. A method for imparting a jarring blow between a pair of telescoping engaged longitudinal bodies one of which is secured in position, the steps comprising:

(1) locking said bodies in a locked position which prevents relative longitudinal movement;

(2) applying an amount of tensional load to the other of said bodies which is not secured in position;

(3) determining a period of time for releasing said bodies, the determination being based solely upon pressure unrelated to the amount of tensional load applied relative to said bodies; and (4) releasing said bodies from said locked position after said predetermined period of time unrelated to said amount of tensional load to impart a high velocity to said other of said bodies for impact against said one of said bodies.

* * * * *